US005385243A

United States Patent [19]

Jackson et al.

[11] Patent Number: 5,385,243

[45] Date of Patent: Jan. 31, 1995

[54] MODULAR SYSTEM FOR AUTOMATICALLY STAGING LETTERS IN CONNECTION WITH A LETTER SORTING MACHINE

[75] Inventors: Billy R. Jackson, North Salt Lake; James P. Hrica, Sandy, both of Utah; Dennis G. Hueman, New Berlin, Wis.; Rodney O. Kirby, Bountiful, Utah

[73] Assignee: Harnischfeger Engineers, Inc., Brookfield, Wis.

[21] Appl. No.: 886,133

[22] Filed: May 20, 1992

[51] Int. Cl.[6] ..... B07C 5/00

[52] U.S. Cl. ..... 209/509; 209/584; 209/960; 198/349.9; 198/350; 414/267; 414/280

[58] Field of Search ..... 209/509, 584, 900; 198/349, 349.9, 350, 465.1; 414/267, 268, 280

[56] References Cited

U.S. PATENT DOCUMENTS

| | | | |
|---|---|---|---|
| 2,669,365 | 2/1954 | Gourdon | 209/900 X |
| 3,638,575 | 2/1972 | Griner | 104/1 |
| 3,759,938 | 9/1973 | Mercadie et al. | 209/900 X |
| 3,884,370 | 5/1975 | Bradshaw et al. | 209/900 X |
| 4,712,964 | 12/1987 | Van Elten et al. | 414/267 X |
| 4,719,694 | 1/1988 | Herberich et al. | 198/349.9 X |
| 4,722,653 | 2/1988 | Williams et al. | 198/346.1 X |
| 4,756,657 | 7/1988 | Kinney | 414/280 X |
| 4,773,807 | 9/1988 | Kroll et al. | 414/282 |
| 4,963,251 | 10/1990 | Böhm et al. | 209/584 X |
| 5,002,449 | 3/1991 | Kita et al. | 414/280 X |
| 5,009,321 | 4/1991 | Keough | 209/900 X |
| 5,044,859 | 9/1991 | Sorensen et al. | 414/273 |
| 5,049,023 | 9/1991 | Knyazkin et al. | 414/280 |
| 5,119,954 | 6/1992 | Svyatsky et al. | 209/900 X |

FOREIGN PATENT DOCUMENTS

| | | |
|---|---|---|
| 0241189 | 10/1987 | European Pat. Off. . |
| 0329642 | 8/1989 | European Pat. Off. . |
| 1547586 | 9/1967 | France . |
| 2630412 | 10/1989 | France . |
| 2643836 | 9/1990 | France . |
| 1235560 | 9/1967 | Germany . |
| 2002749 | 7/1971 | Germany . |
| 2313429 | 6/1974 | Germany . |
| 2130186 | 5/1984 | United Kingdom . |

*Primary Examiner*—Robert P. Olszewski
*Assistant Examiner*—Dean A. Reichard
*Attorney, Agent, or Firm*—Michael, Best & Friedrich

[57] ABSTRACT

A letter sorting apparatus comprising a letter sorting machine, and an automatic storage and retrieval system including a staging rack defining a plurality of staging locations, and a storage and retrieval machine which is positioned to receive letters from the sorting machine and to present letters for input to the sorting machine and which is operable to stage letters in and retrieve letters from the staging locations.

26 Claims, 9 Drawing Sheets

MODULAR SYSTEM FOR AUTOMATICALLY STAGING LETTERS IN CONNECTION WITH A LETTER SORTING MACHINE

FIELD OF THE INVENTION

The invention relates to letter sorting systems, such as systems employed by the United States Postal Service. The invention also relates to automatic storage and retrieval systems.

BACKGROUND OF THE INVENTION

The United States Postal Service employs many types of letter sorting machines. Some examples are bar code sorters, optical character readers, multiple position letter sorters and delivery bar code sorters. Such letter sorting machines are well known to those skilled in the art, and these machines will therefore not be described in greater detail.

The operation of these machines is currently quite labor intensive. Letters are generally conveyed to and from letter sorting machines in trays which are in turn conveyed in relatively large carts that are moved by hand. This requires a significant amount of labor, and the carts take up a significant amount of floor space. Two-pass delivery bar code sorters also require staging or storing of letters between passes. Such staging is currently done with the same trays and carts, resulting in the same disadvantages.

Many letter sorting machines are modular, i.e., their capacity can be increased or decreased by adding or removing modular units.

SUMMARY OF THE INVENTION

The invention provides a modular system for automatically staging or storing trays of letters for input to a letter sorting machine and for automatically staging letters dispensed by a letter sorting machine. The system can be used in connection with any type of letter sorting machine. When used in connection with a two-pass delivery bar code sorter, the system also automatically presents letter trays in proper order for the second pass, automatically stages letters from the letter sorting machine after the second pass, and automatically presents letter trays in proper order for conveyance after the second pass.

The system is modular, so it can be tailored to a letter sorting machine of virtually any size. The modular nature of the system enables relatively quick installation of the system in existing facilities. The system can be fit within various types of building layouts and can be interfaced with various delivery and take-away systems. The system can be located close to a letter sorting machine so that relatively little labor is required to move letters from the sorting machine to the system. The system takes advantage of available vertical air space and requires a minimum amount of floor space. The height of the system can be varied to take advantage of existing overhead clearance. The system provides faster and more accurate staging than can be done manually.

Overall, the system provides substantial floor space savings, substantial capital cost savings, and substantial labor savings.

Specifically, the system provides, along with a letter sorting machine, an automatic storage and retrieval system. The automatic storage and retrieval system includes a staging or storage rack and a storage and retrieval machine which is positioned to receive letter trays from the sorting machine and to present letter trays for input to the sorting machine and which is operable to stage letter trays in and retrieve letter trays from the staging rack. The staging rack is modular and includes a number of discrete modules each providing several levels and bays of staging locations, such that the number of staging locations can be varied by varying the number of modules. The modules are arranged end-to-end, so that the length of the system can be adapted to the length of the letter sorting machine. The staging locations of the staging rack are by design provided by cantilevered shelves. Because the shelves are cantilevered, there are no partitions between adjacent staging locations. This affords a maximum number of staging locations in a given space.

The storage and retrieval machine is generally conventional and includes a mast movable horizontally adjacent the staging rack, a carriage movable vertically relative to the mast, and an extractor movable relative to the carriage for placing letter trays in and extracting letter trays from the staging rack. The carriage and extractor assembly differs from known assemblies in that it has been specifically adapted for handling letter trays. Rather than extending below and picking up the object to be moved (the letter tray), the extractor of the present invention extends above a letter tray and pulls or slides the letter tray onto the carriage. The extractor includes two hoop-like mechanisms that swing down and engage or capture the letter tray, and the combination of the hoop-like mechanisms and the location of the extractor immediately above the letter tray substantially prevents letters from coming out of the letter tray while the storage and retrieval machine is moving the letter tray.

When used in conjunction with a two-pass delivery bar code sorter (DBCS), the system comprises a sweep rack on each side of the DBCS. Each sweep rack provides, for each output stacker of the DBCS on the same side of the DBCS, a respective letter tray staging position. The sweep racks are located such that an operator (a sweep operator) can easily move or "sweep" letters from an output stacker to the associated letter tray supported by the sweep rack. The sweep racks are, like the staging rack, modular. The staging rack and the storage and retrieval machine are located on one side of the DBCS, and the sweep rack on that side of the DBCS (the near-side sweep rack) is located beneath the staging rack. By design, the modules of the sweep rack are the same length as the modules of the staging rack, and each staging rack module is mounted on top of a respective sweep rack module.

The system also comprises an input tray transport system or conveyor for transporting or conveying letter trays from the opposite-side sweep rack to the storage and retrieval machine. This tray transport system also conveys trays from the near-side sweep rack to the storage and retrieval machine. The tray transport system is by design horseshoe-shaped and runs through the opposite-side sweep rack, around the end of the DBCS, and through the near-side sweep rack. The tray transport system terminates adjacent the station of the DBCS feed operator. The tray transport system is located in the sweep racks such that a sweep operator can easily place trays from either sweep rack onto the tray transport system. The tray transport system is accessible by the storage and retrieval machine at a point near the downstream end of the tray transport system, i.e., at the end of the near-side sweep rack. All letter trays from the opposite-side sweep rack are conveyed to either the feed operator or the storage and retrieval machine by the tray transport system.

The system also comprises, in the near-side sweep rack, output belts or conveyors for carrying letter trays to the feed operator. Each output belt is aligned with and located behind an associated level of staging positions in the near-side sweep rack, such that the sweep operator can push letter trays from any one of the staging positions onto the associated output belt. The downstream end of each output belt is located adjacent the feed operator station, and each output belt is accessible adjacent its downstream end by the storage and retrieval machine.

The operation of the system with a two-pass DBCS will be described only generally at this point. A more detailed description follows.

Letter trays coming to the DBCS are placed on the upstream end of the input tray transport system. Many of these letter trays are staged by the storage and retrieval machine, and the remainder of the letter trays are retrieved by the storage and retrieval machine and placed on one of the output belts to be delivered to the feed operator. After the trays on the input tray transport system have been delivered to the feed operator, the storage and retrieval machine delivers the trays in the staging rack to the feed operator.

During and after first pass, the sweep operator places letters from each output stacker into the associated letter tray in the associated sweep rack. The letter tray carries a bar code identifying the associated DBCS output stacker. Full letter trays are placed on the input tray transport system for transport to the storage and retrieval machine. When first pass has ended, letter trays remaining on the opposite-side sweep rack are placed on the input tray transport system for transport to the storage and retrieval machine, and letter trays remaining in the near-side sweep rack are pushed onto the output belts for transport to the feed operator.

As the system presents letter trays to the feed operator for second pass, the system insures that all filled trays that were placed on the input tray transport system are presented to the feed operator in proper sequence. Operation during second pass is similar to operation during first pass. After second pass, letter trays are staged for subsequent conveyance rather than for another pass through the DBCS.

Other features and advantages of the invention will become apparent to those skilled in the art upon review of the following detailed description, claims and drawings.

Figure 1:
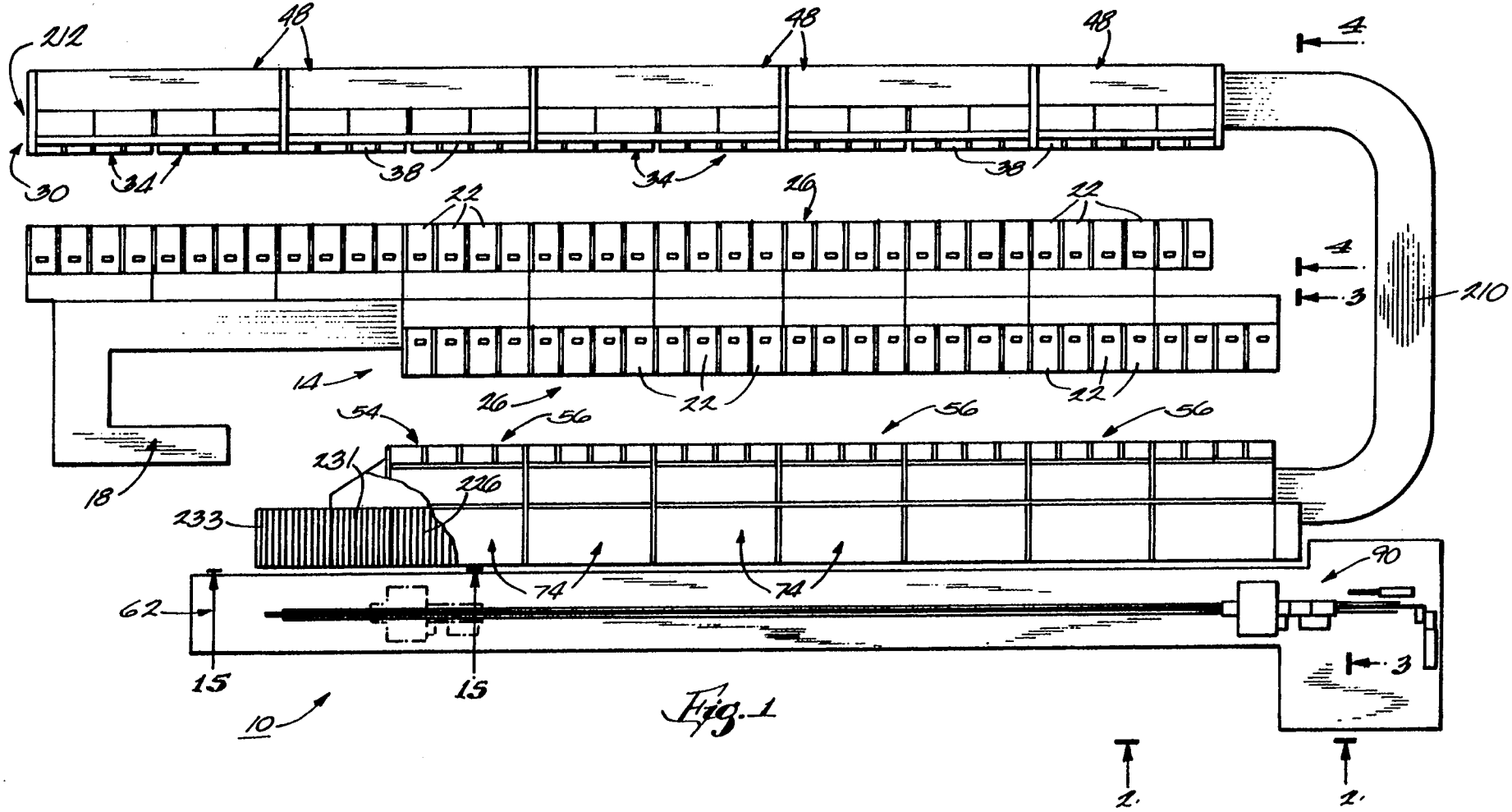
FIG. 1 is a top plan view of a letter sorting apparatus embodying the invention.
Figure 3:
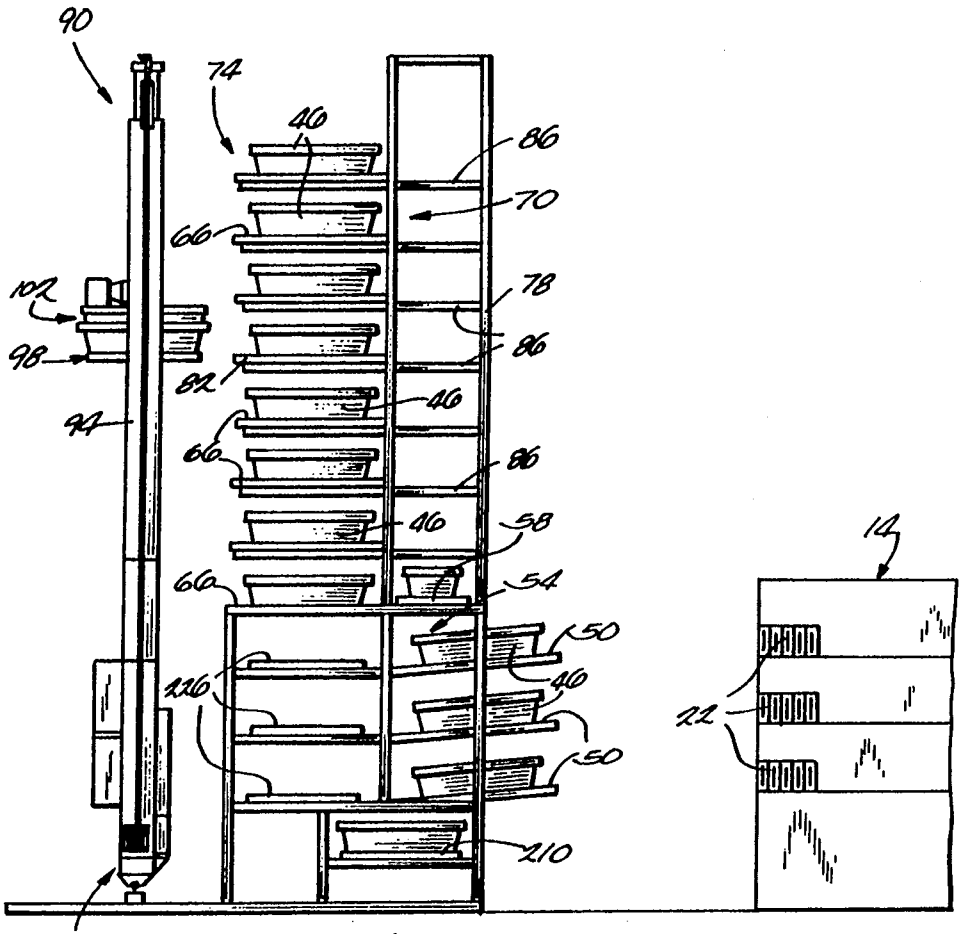
FIG. 3 is a view taken along line 3—3 in FIG. 1.
Figure 2:
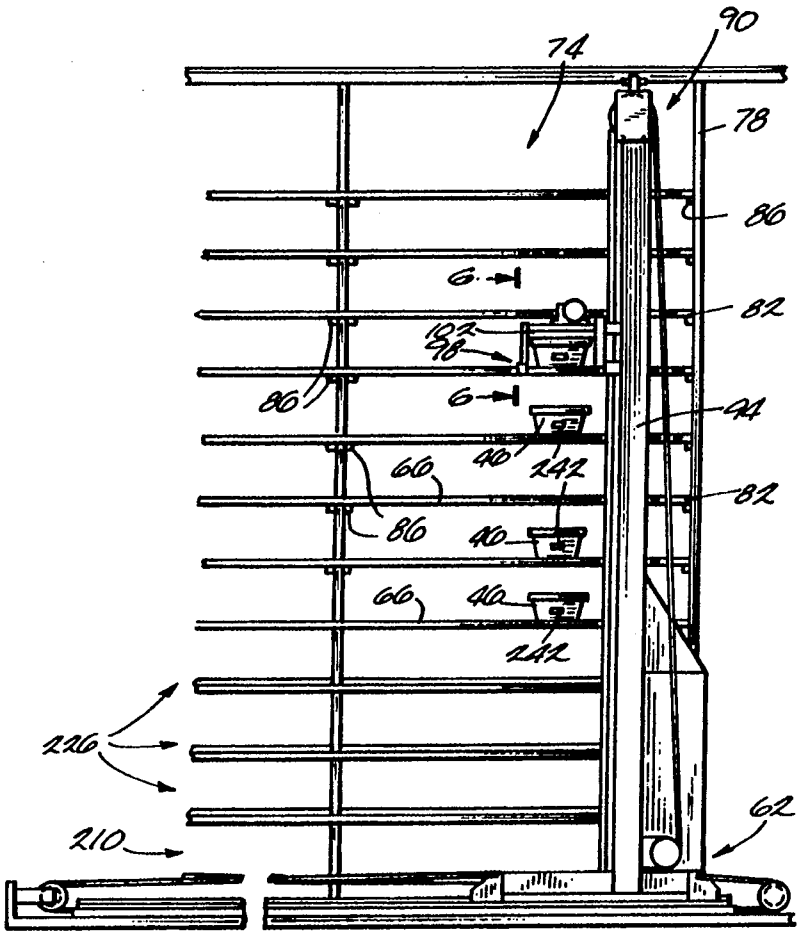
FIG. 2 is a view taken along line 2—2 in FIG. 1.
Figure 4:
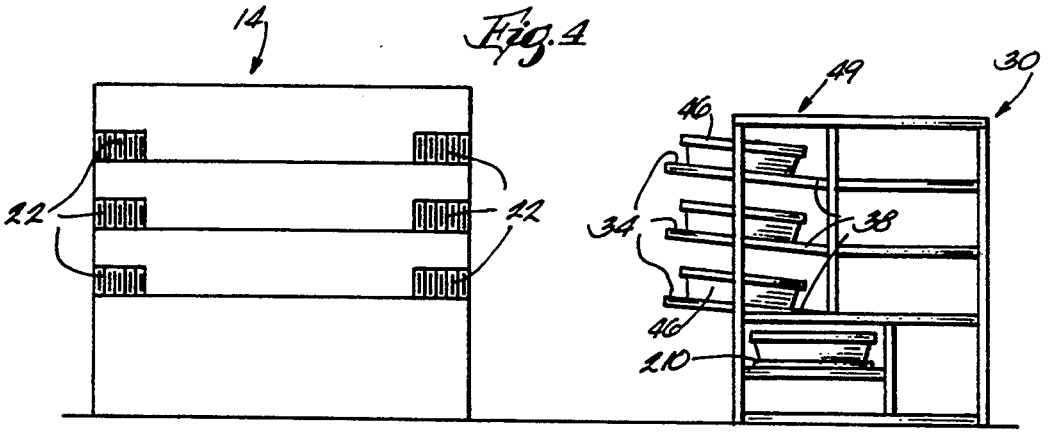
FIG. 4 is a view taken along line 4—4 in FIG. 1.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A letter sorting apparatus 10 embodying the invention is illustrated in FIGS. 1–5. The apparatus 10 comprises a letter sorting machine 14. While the invention is applicable to any type of letter sorting machine, the illustrated letter sorting machine is a delivery bar code sorter (DBCS) that is utilized by the United States Postal Service and that is manufactured by Electrocom Automation, Inc. of Dallas, Tex. Such a DBCS is well known to those skilled in the art and will be described only to the extent necessary for a full understanding of the present invention. Other types of letter sorting machines to which the invention is applicable include, for example, bar code sorters, optical character readers and multiple position letter sorting machines.

The DBCS 14 has opposite ends (left and right ends in FIG. 1) and opposite sides (upper and lower or opposite and near sides in FIG. 1). The DBCS 14 includes, at its left end, means 18 for receiving letters to be sorted. A feed operator puts letters into the receiving means or input of the DBCS 14. The DBCS 14 also includes means for sorting letters, and means on both of the upper and lower sides for dispensing sorted letters. The dispensing means includes three levels of output stackers 22 on both sides of the DBCS 14. A sweep operator on each side removes sorted letters from the output stackers 22. The portion of the DBCS 14 including the output stackers 22 is made of modules 26. Each module 26 is approximately 110 inches long and includes eight output stackers per level.

Letters are sorted to individual area routes by passing the letters twice through the DBCS 14. In other words, letters are initially put into the receiving means 18, and the DBCS 14 reads the bar codes on the letters, partially sorts the letters, and dispenses the letters to the output stackers 22. The letters are then again put in the receiving means for a second pass through the DBCS. Letters in the output stackers 22 must be presented to the receiving means in the proper order for the second pass. After second pass, the DBCS 14 dispenses to the output stackers 22 letters sorted to the individual carrier routes.

Before and after sortation by the DBCS 14, letters are staged and transported in conventional letter receptacles or trays 46.

The apparatus 10 also comprises means adjacent the opposite side of the DBCS 14 for storing or staging trays of letters. While various suitable staging means could be employed, in the illustrated embodiment, such means includes (see FIGS. 1 and 4) a modular staging or storage or sweep rack 30 defining (see FIG. 4) three levels of staging or storage positions 34, with each level being generally aligned with a respective one of the levels of output stackers 22 on the opposite side of the DBCS 14. Each level is defined by an outwardly and upwardly sloped shelf 38 and includes eight staging positions, with each staging position being generally aligned with a respective one of the output stackers 22 of the DBCS 14. Each of the staging positions is adapted to receive a letter tray 46, so that a sweep operator can simply "sweep" letters from an output stacker of the DBCS 14 to the letter tray 46 in the associated staging position. Each tray 46 has thereon a bar code 47 (FIG. 5) identifying the associated output stacker 22. The sweep rack 30 is made of modules 48 (FIG. 1). By design, each module 48 of the sweep rack is approximately 110 inches long, like the modules 26 of the DBCS 14, and includes eight staging positions per level. Located on top of the sweep rack 30 is a non-powered skate wheel conveyor 49 (FIG. 4), the reason for which is explained below.

The apparatus 10 also comprises means adjacent the near side of the DBCS 14 for storing or staging trays of letters from the DBCS sorting means or output stackers 22. The staging means preferably includes means defining a plurality of letter tray storage or staging positions 50. In the illustrated embodiment, the staging means is substantially identical to the sweep rack 30 and includes (see FIGS. 1, 3 and 5) a modular sweep rack 54 defining three levels of letter tray staging positions, with each level being generally aligned with a respective level of DBCS output stackers 22. Each level includes a plurality of staging positions, with each staging position being generally aligned with a respective output stacker 22. Adjacent staging positions on each shelf are separated by separator strips 42 (FIG. 5) on the upper surface of the shelf. The sweep rack 54 is made of modules 56 (FIG. 1). Each module 56 of the sweep rack 54 is approximately 110 inches long and includes eight letter tray staging positions per level. Located on top of the sweep rack 54 is a non-powered skate wheel conveyor 58 (FIGS. 3 and 5), the reason for which is explained below.

The apparatus 10 also comprises means separate from the DBCS 14 for automatically storing or staging letters from the DBCS dispensing means or output stackers 22, means separate from the DBCS for automatically storing or staging letters or letter trays for input to the DBCS receiving means, means for automatically presenting letters or letter trays in proper order for the second pass through the DBCS 14, means for automatically storing or staging letters from the output stackers 22 after the second pass, and means for automatically presenting letters or letter trays in proper order for conveyance after the second pass. All of the foregoing preferably include (see FIGS. 1–3 and 5) an automatic storage and retrieval system 62 located adjacent the near side of the DBCS 14.

The automatic storage and retrieval system 62 includes means defining a plurality of staging or storage locations 66. This means preferably includes (see FIGS. 2 and 3) a modular staging or storage rack 70 mounted on top of the near-side sweep rack 54. The staging rack 70 is made of modules 74. Each module 74 of the staging rack 70 is approximately 110 inches long so that one staging rack module 74 is mounted on top of each sweep rack module 56. Each staging rack module 74 includes (see FIG. 3) a frame 78 mounted on top of the sweep rack 54, seven vertically spaced shelves 82, and cantilever supports 86 which are supported by the frame 78 and which support the shelves 82. Each shelf 82 defines a number of staging locations 66. The use of cantilever supports allows the shelves to be supported such that there are no partitions between adjacent letter tray staging locations. Also, the top of the sweep rack 54 defines a level of letter tray staging locations, so that the sweep rack 54 and the staging rack 70 define eight levels of staging locations, and a plurality of bays of staging locations, with each bay including eight vertically aligned letter tray locations.

The automatic storage and retrieval system 62 also includes (see FIGS. 1–3) a storage and retrieval machine 90 positioned to receive trays of letters from the DBCS 14 and to present letter trays for input to the DBCS 14. The storage and retrieval machine 90 is also operable to stage letter trays in and retrieve letter trays from the staging locations in the staging rack 70.

As is known in the art, the storage and retrieval machine 90 includes (see FIG. 2) a mast 94 movable horizontally adjacent the staging rack 70, a carriage 98 movable vertically relative to the mast, and an extractor 102 movable relative to the carriage for placing letter trays in and extracting letter trays from the staging locations in the staging rack 70. While the illustrated apparatus 10 has only one staging rack on one side of the storage and retrieval machine 90, it should be understood that the storage and retrieval machine 90 is capable of accessing a staging rack on the other side of the storage and retrieval machine 90.

The carriage 98 and extractor 102 are more particularly illustrated in FIGS. 6 through 11. The carriage 98 includes (see FIGS. 6 and 7) a frame 106 providing an upwardly facing surface 110 for supporting a letter tray 46. The extractor 102 includes a plate-like top member 114 supported by the frame 106 in upwardly spaced, parallel relation to the tray supporting surface 110. The extractor 102 also includes a plate-like intermediate member 118 which is located below the top member 114 and which is supported by the top member 114 for horizontal sliding movement relative thereto. The extractor 102 also includes a plate-like bottom member 122 which is located below the intermediate member 118 and which is supported by the intermediate member 118 for horizontal sliding movement relative thereto and thus relative to the top member 114.

Figure 7:
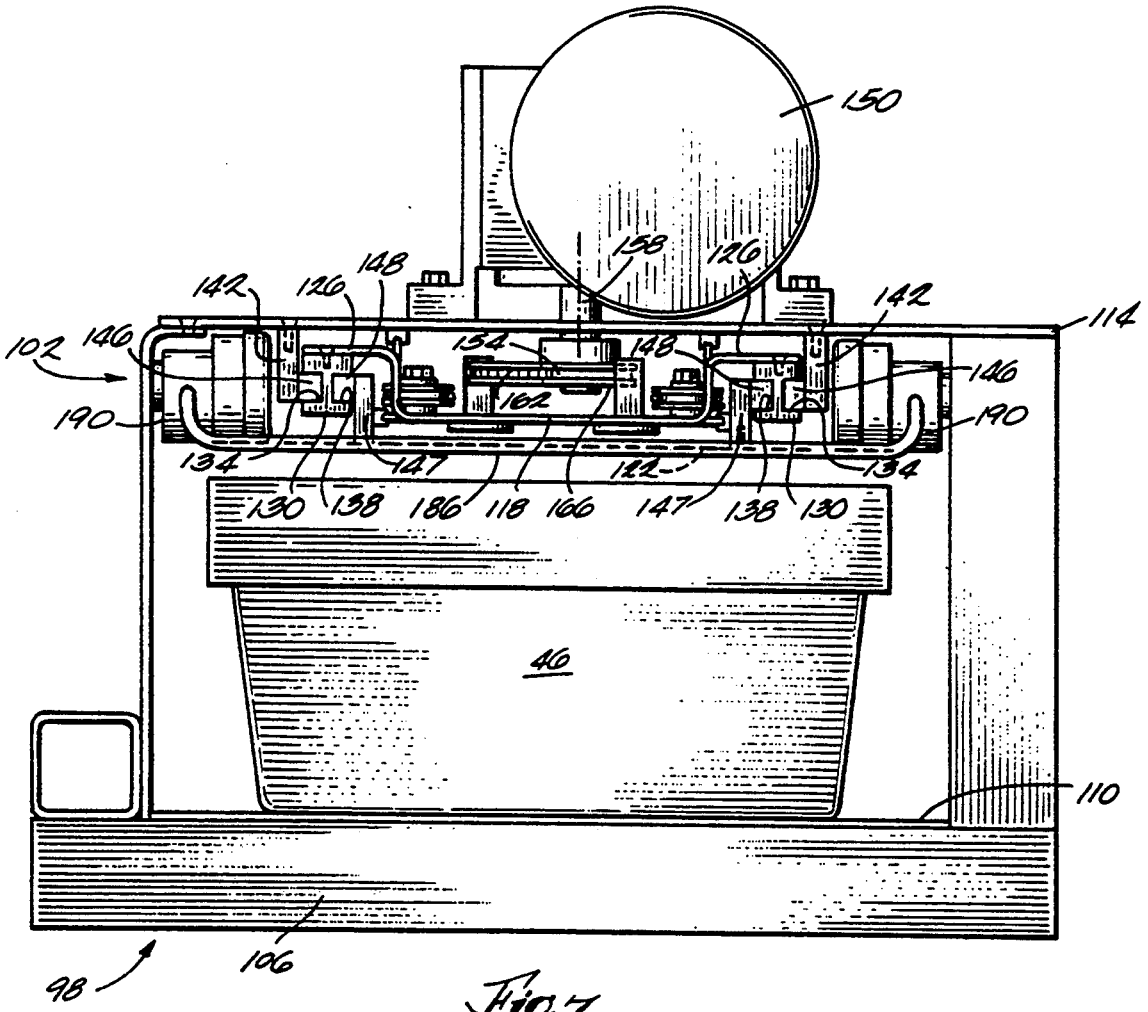
FIG. 7 is a left side elevational view of the carriage and extractor assembly as shown in FIG. 6.

More particularly, as best shown in FIG. 7, the intermediate member 118 includes, adjacent each corner thereof, an upwardly offset, horizontally extending mounting flange 126. Extending downwardly from each of the flanges 126 is an H-shaped bearing block 130 defining both an outwardly opening bearing track 134 and an inwardly opening bearing track 138. A pair of bearing supporting members 142 extend downwardly from the top member 114. One of the bearing supporting members 142 has mounted thereon a bearing strip 146 slidably received in the bearing track 134 of one of the bearing blocks 130, and the other bearing supporting member 142 has mounted thereon a bearing strip 146 slidably received in the bearing track 134 of the other bearing block 130. A pair of bearing supporting members 147 extend upwardly from the bottom member 122. One of the bearing supporting members 147 has mounted thereon a bearing strip 148 slidably received in the bearing track 138 of one of the bearing blocks 130, and the other bearing supporting member 147 has mounted thereon a bearing strip 148 slidably received in the bearing track 138 of the other bearing block 130. The bearing strips 146 and 148 can be made of any suitable low-friction material.

Figure 8:
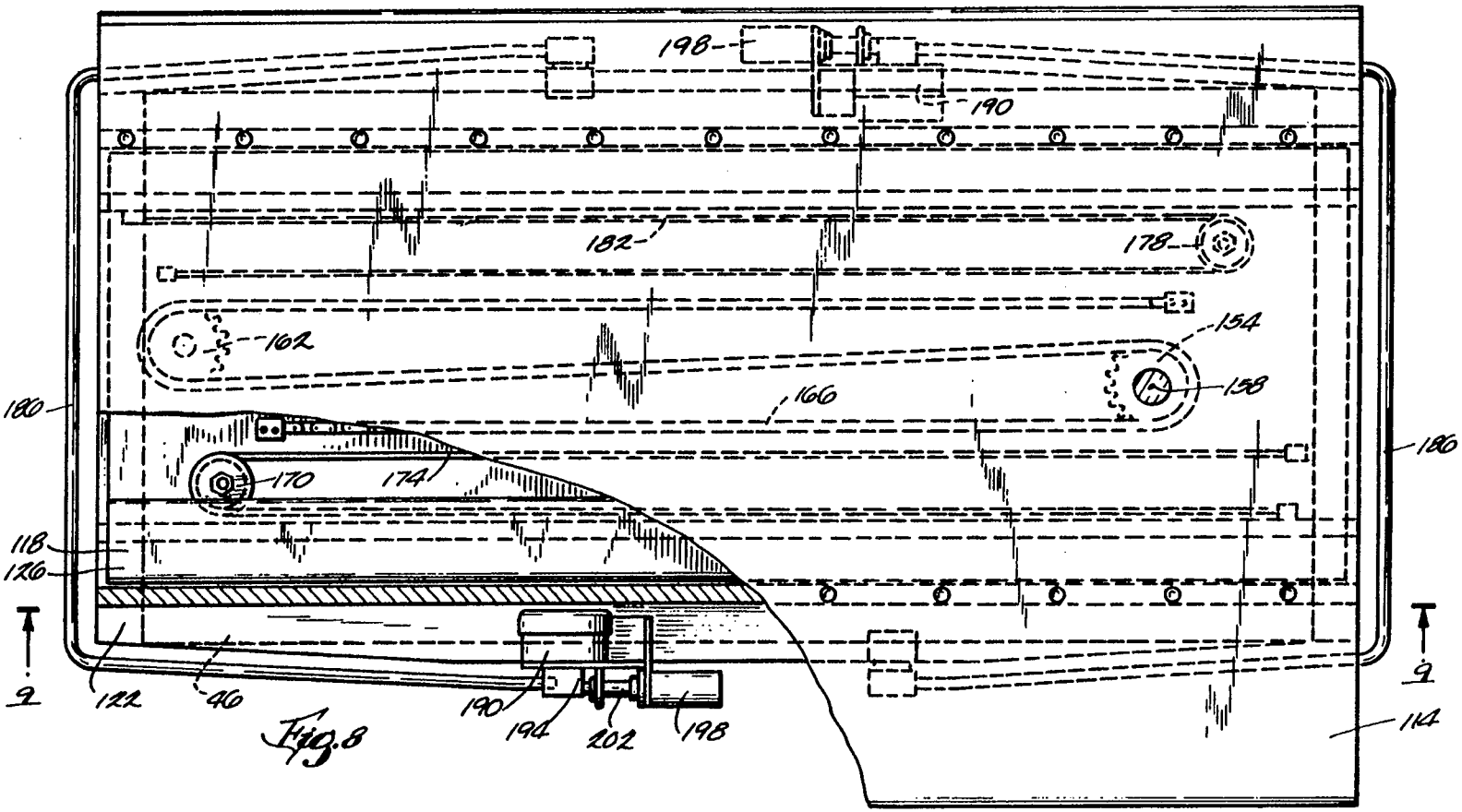
FIG. 8 is a top plan view, partially broken away, of the carriage and extractor assembly.
Figure 9:
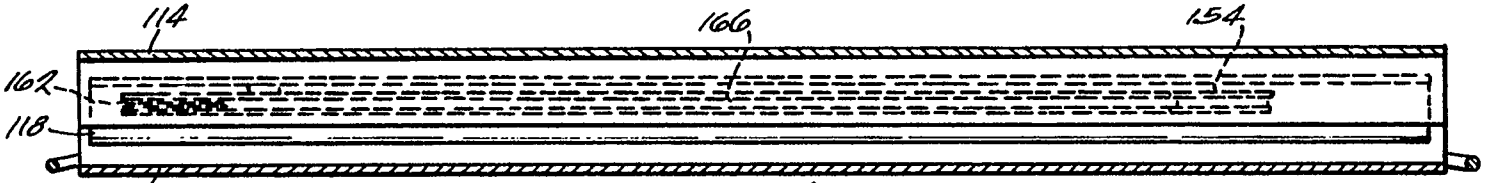
FIG. 9 is a view taken along line 9—9 in FIG. 8.
Figure 10:
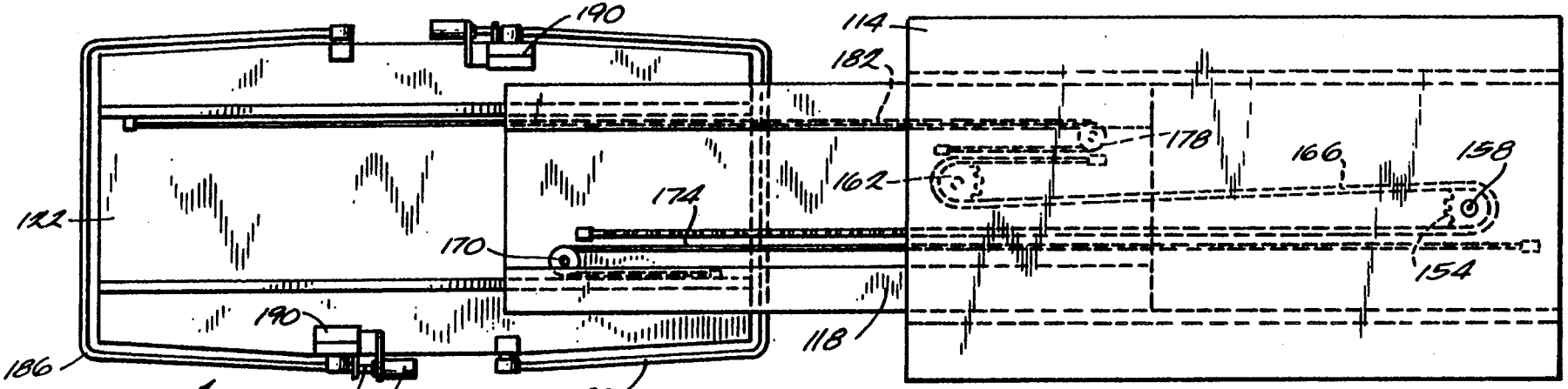
FIG. 10 is a reduced top plan view of the carriage and extractor assembly with the extractor extended.
Figure 11:
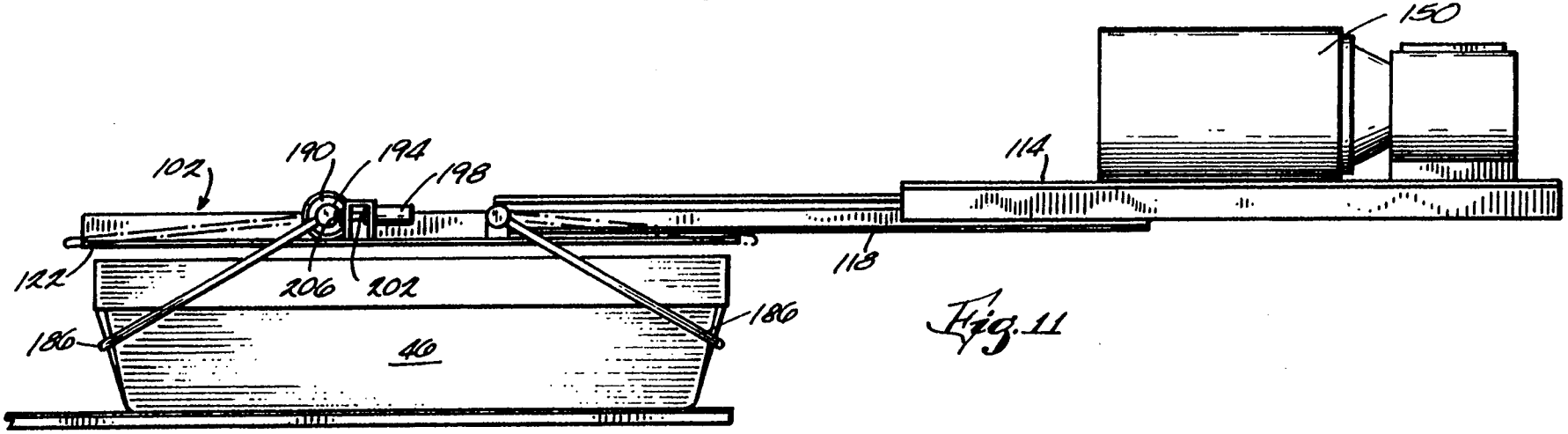
FIG. 11 is a side elevational view of the carriage and extractor assembly as shown in FIG. 10.

Means are provided for extending and retracting the extractor 102, i.e., for causing sliding-movement of the intermediate and bottom members 118 and 122 relative to the top member 114. Preferably, this means includes (see FIGS. 6 and 7) a drive motor 150 mounted on the top member 114. The motor 150 is reversible and drives a sprocket 154 (FIGS. 9 and 10) which is located below the top member 114 and which rotates about a vertical axis 158. The means for extending and retracting the extractor 102 also includes an idler sprocket 162 rotatably supported by the top member 114, and a drive chain 166 which is driven by the drive sprocket 154, which passes around the idler sprocket 162, which has a first end fixed to the intermediate member 118 adjacent the right end thereof (as shown in FIG. 8), and which has a second end fixed to the intermediate member 118 adjacent the left end thereof (as shown in FIG. 8). Thus, as is apparent from viewing FIGS. 8 and 10, clockwise rotation of the drive sprocket 154 pulls the intermediate member 118 to the left relative to the top member 114, and counterclockwise rotation of the drive sprocket pulls the intermediate member 118 to the right relative to the top member 114.

The means for extending and retracting the extractor 102 also includes (see FIGS. 8 and 10) an idler pulley 170 pivotally mounted on the intermediate member 118, a cable 174 which is reeved around the pulley 170 and which has one end fixed to the top member 114 and an opposite end fixed to the bottom member 122, an idler pulley 178 rotatably mounted on the intermediate member 118, and a cable 182 which is reeved around the pulley 178 and which has one end fixed to the top member 114 and an opposite end fixed to the bottom member 122. As is apparent from viewing FIG. 8, movement of the intermediate member 118 to the left causes movement of the pulley 170 relative to the top member 114, and such movement of the pulley 170 causes the cable 174 to pull the bottom member 122 to the left relative to the intermediate member 118. Movement of the intermediate member 118 to the right relative to the top member 114 causes movement of the pulley 178 to the right relative to the top member 114, and such movement of the pulley 178 causes the cable 182 to pull the bottom member 122 to the right relative to the intermediate member 118. The cable and pulley arrangements cause the bottom member 122 to move twice as fast as the intermediate member 118.

Thus, clockwise rotation of the drive sprocket 154 causes movement of the intermediate member 118 and bottom member 122 to the left (as shown in FIG. 8), and counterclockwise rotation of the drive sprocket causes movement of the intermediate member 118 and bottom member 122 to the right.

Figure 6:
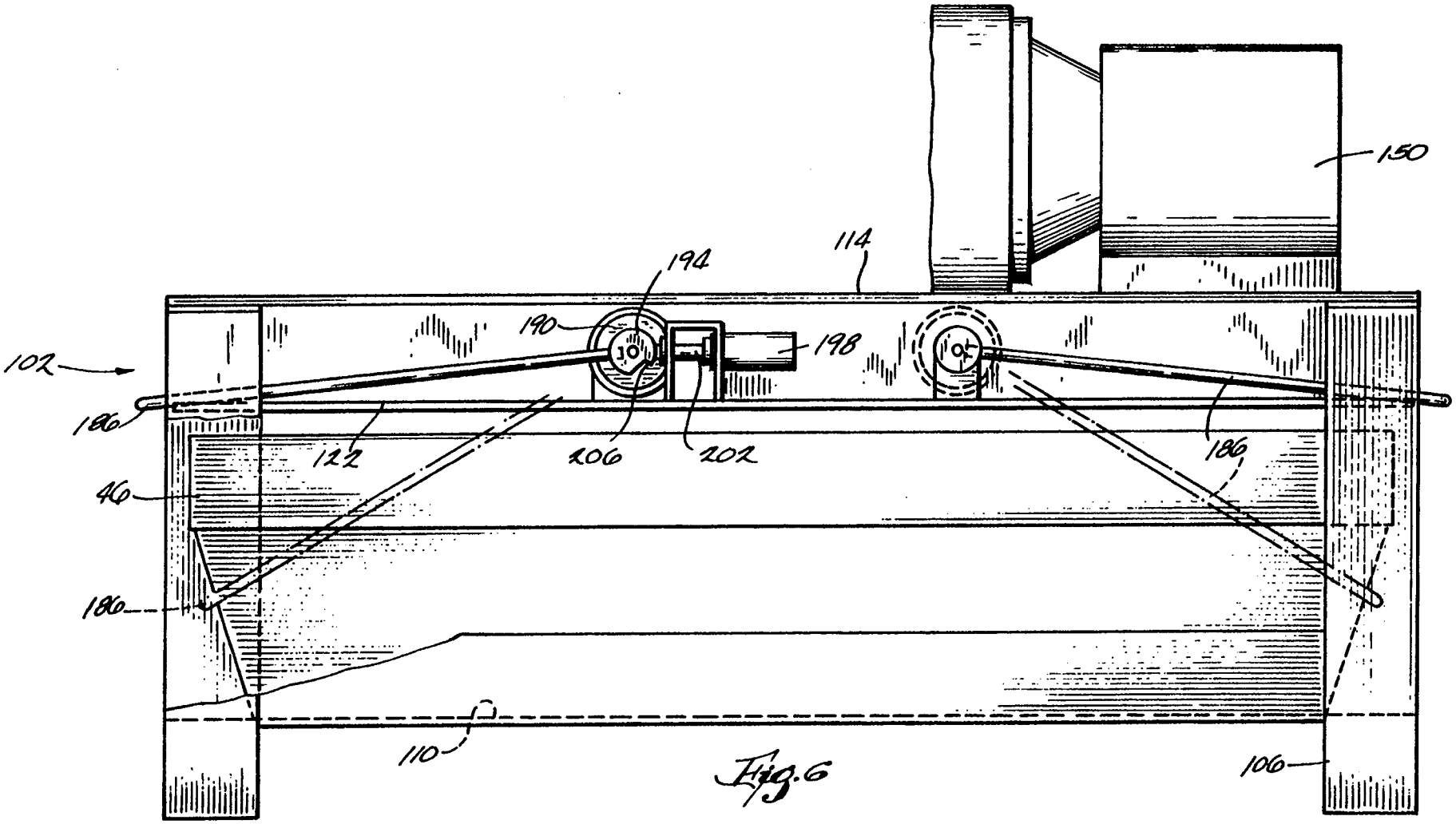
FIG. 6 is an enlarged view which is taken along line 6—6 in FIG. 2 and which shows the carriage and extractor assembly.

Means are provided on the bottom member 122 for selectively engaging a letter tray 46 so that the letter tray 46 moves horizontally in common with the bottom member 122. Such means preferably includes (see FIGS. 6, 8, 10 and 11) a pair of generally U-shaped members or hoops 186 pivotally mounted on the bottom member 122. Referring to FIG. 6, each of the hoops 186 is pivotally moveable between an upper position (shown in phantom) and a lower position (shown in solid lines). When the hoops 186 are in their upper positions, the bottom member 122 can pass over a letter tray 46 located in the staging rack 70 without interference between the hoops 186 and the letter tray 46. When the hoops 186 are moved to their lower positions, each of the hoops 186 engages a respective end of the letter tray 46 so as to substantially prevent horizontal movement of the letter tray 46 relative to the bottom member 122.

Means are provided for selectively pivoting the hoops 186 relative to the bottom member 122. Such means preferably includes, for each of the hoops 186, a torsional solenoid 190 (FIGS. 6 and 8) which is mounted on the bottom member 122 and which is drivingly connected to one end of the hoop. The solenoid 190 is biased so as to bias the hoop to its upper position, and actuation of the solenoid 190 causes movement of the hoop to its lower position. Means are provided for selectively retaining the hoop in its lower position. This means preferably includes (see FIGS. 6 and 11) a cam 194 fixed to the hoop for pivotal movement therewith about the solenoid axis, and a linear solenoid 198 having an outwardly biased plunger 202 engaging the cam 194. When the hoop moves to its lower position, pivotal movement of the cam allows the plunger 202 to "fall off" a step 206 on the cam, and the plunger thereafter interferes with the step so as to prevent pivotal movement of the cam and the hoop in the opposite direction. Engagement of the step 206 by the plunger 202 therefore prevents movement of the hoop from its lower position. Accordingly, neither of the solenoids needs to be actuated in order to retain the hoop in its lower position. In order to return the hoop to its upper position, the linear solenoid is actuated. This retracts the plunger so that the plunger 202 no longer interferes with the step 206, and this allows the natural bias of the torsional solenoid 190 to return the hoop to its upper position.

This arrangement minimizes the amount of electricity needed to operate the hoops 186. The torsional solenoids naturally bias the hoops 186 to their upper positions. Only a momentary current is necessary to move the hoops 186 to their lower positions. Thereafter, the linear solenoids retain the hoops 186 in their lower positions. Only a momentary actuation of the linear solenoids is necessary to return the hoops 186 to their upper positions. Once the steps 206 clear the plungers 202 of the linear solenoids, the linear solenoids can be deactivated.

The carriage and extractor assembly operates as follows. When the supporting surface 110 of the carriage is aligned with a shelf 82 in the staging rack 70, the drive sprocket 154 is rotated clockwise so as to extend the bottom member 122 above a letter tray 46 on the shelf. The hoops 186 are then moved to their lower positions to capture the letter tray 46, and the drive sprocket is rotated counterclockwise so as to retract the bottom member 122. Engagement of the letter tray 46 by the hoops 186 causes the letter tray 46 to move with the bottom member 122 and slide off the shelf onto the carriage supporting surface 110. Location of the bottom member 122 immediately above the letter tray 46 substantially prevents letters from coming out of the tray 46 during movement of the tray 46. The hoops 186 remain in their lower positions during movement of the carriage relative to the staging rack 70.

Figure 5:
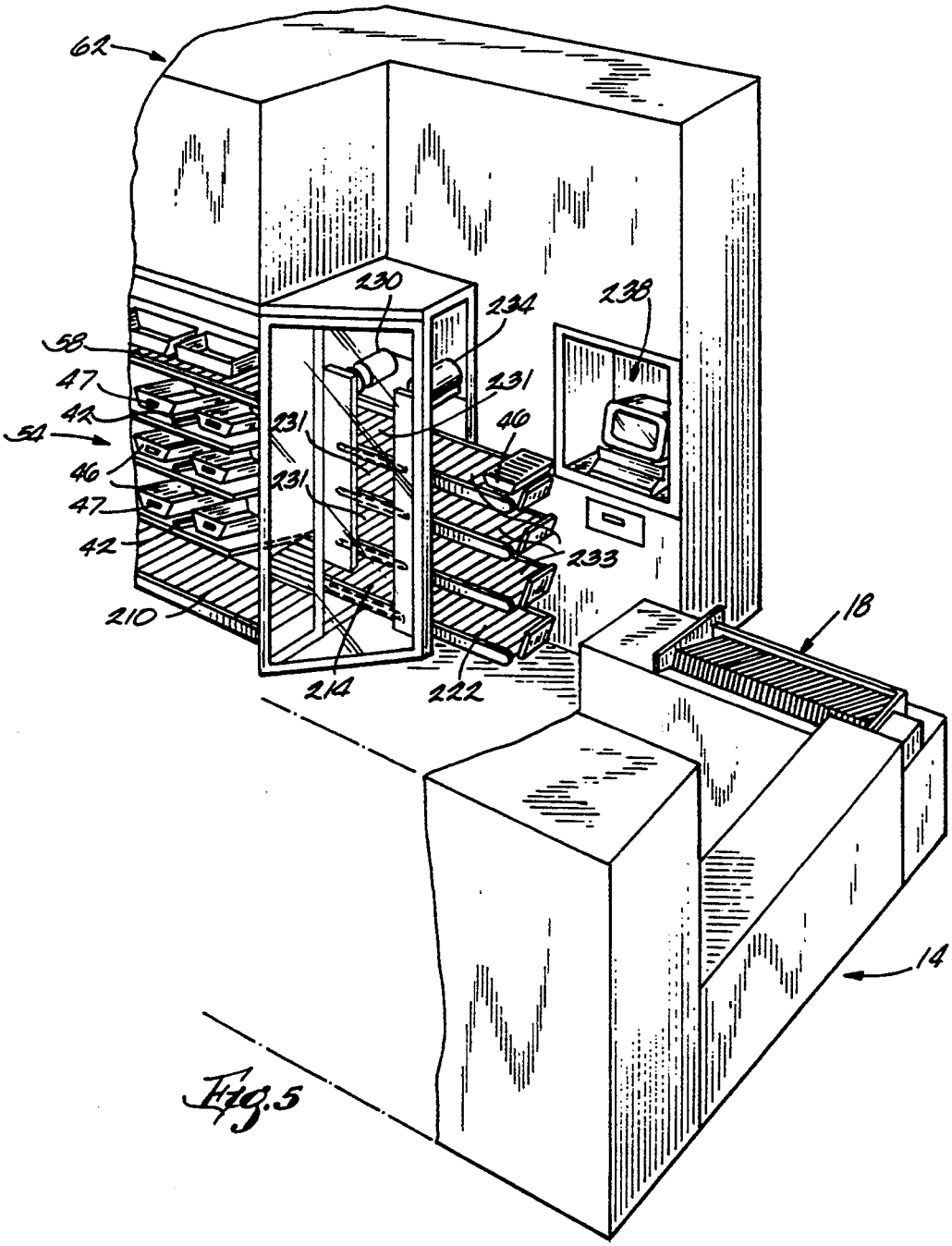
FIG. 5 is a partial perspective of the apparatus.

The apparatus 10 further comprises means for transporting or conveying letter trays from the opposite-side sweep rack 30 to the storage and retrieval machine 90. The transporting means includes (see FIG. 1) a horseshoe-shaped lower or input tray transport system or conveyor 210. The input tray transport system 210 includes (see FIG. 4) an upstream portion running through the opposite-side sweep rack 30 below the sweep rack staging positions 34. This portion of the tray transport system 210 runs from left to right as shown in FIG. 1. The tray transport system 210 also includes (see FIG. 3) a downstream portion running through the near-side sweep rack 54 beneath the staging positions 50 thereof. This portion of the tray transport system 210 runs from right to left as shown in FIG. 1. The tray transport system 210 also includes a middle portion which runs from top to bottom in FIG. 1 and which connects the upstream and downstream portions of the tray transport system 210. As shown in FIG. 5, the tray transport system 210 jogs inwardly (downwardly in FIG. 1) at its downstream end. The upstream end of the tray transport system 210 is referred to hereinafter as the tray induction station 212 (FIG. 1), because trays can be placed on the tray transport system at this point. Several motors (not shown) drive the tray transport system 210.

Figure 15:
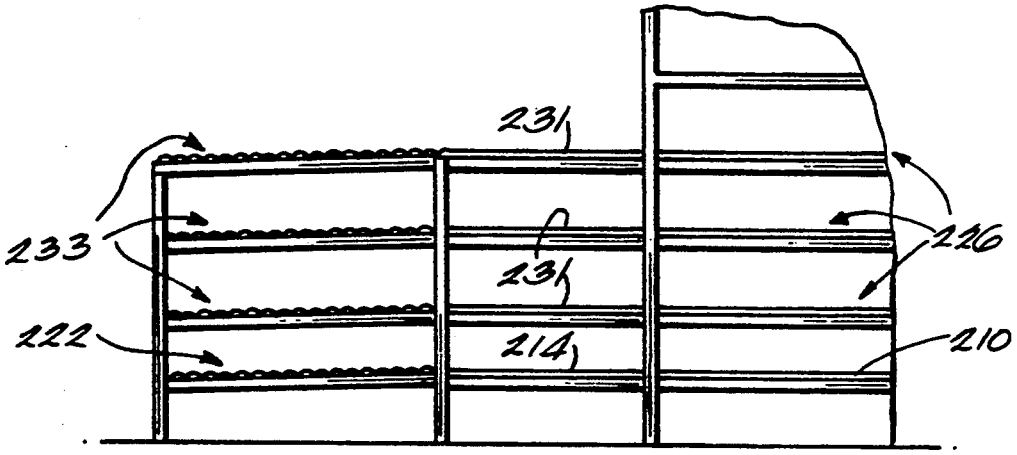
FIG. 15 is a view taken along line 15—15 in FIG. 1.

As shown in FIGS. 5 and 15, pick-up and delivery powered conveyor rollers (P&D station) 214 are located adjacent the downstream end of the tray transport system 210 and run from right to left in FIG. 1. Trays on the input tray transport system 210 are deposited onto the P&D station 214, which is accessible by the storage and retrieval machine 90. A set of gravity rollers 222 is located adjacent the downstream end of the P&D station 214. The rollers 222 define an operator station. The gravity rollers 222 operate by gravity and present trays to the feed operator. If a tray 46 at the P&D station 214 is not to be retrieved by the storage and retrieval machine 90, the P&D powered rollers 214 convey the tray 46 to the operator station gravity rollers 222 so that the tray 46 is delivered to the operator. This will happen when the control system cannot read a tray bar code.

When a tray 46 in the opposite-side sweep rack 30 becomes full, or when a DBCS pass is ended, an operator removes the tray 46 from its staging position in the opposite-side sweep rack 30 and places the tray 46 on the tray transport system 210. The tray 46 is then conveyed to the pick-up and delivery station 214 where the tray 46 can be retrieved by the storage and retrieval machine 90 or allowed to pass to the operator (in the event of a bar code "no-read").

The apparatus 10 also comprises means for conveying or transporting letter trays from the near-side sweep rack 54 to the storage and retrieval machine 90. This transporting means preferably includes (see FIGS. 3 and 15) the input tray transport system 210 and three additional output belts or conveyors 226 running through the near-side sweep rack 54. Each of the output belts 226 runs from right to left as shown in FIG. 1. Each belt 226 is located immediately behind an associated level of staging positions 50 such that a sweep operator can push letter trays from any one of the staging positions 50 onto the associated output belt 226. Means are provided for driving the belts 226. Such means includes (see FIG. 5) a drive motor 230 selectively clutched to drive each of the belts 226.

As shown in FIGS. 1, 5 and 15, P&D powered conveyor rollers (P&D rollers or P&D station) 231 are located adjacent the downstream end of each of the output belts 226 and run from right to left in FIG. 1. Each set of P&D conveyor rollers 231 is identical to the P&D conveyor rollers 214. A tray 46 on one of the output belts 226 is deposited onto the associated set of P&D powered conveyor rollers 231, which is accessible by the storage and retrieval machine 90. A set of gravity rollers 233 is located adjacent the downstream end of each P&D station 231. Each set of gravity rollers 233 is identical to the gravity rollers 222. Each set of rollers 233 defines an operator station, where the trays are accessible by the feed operator.

Means are provided for driving the powered conveyor rollers 214 and 231. Such means preferably includes (see FIG. 5) a drive motor 234 selectively clutched to drive each of the sets of rollers 214 and 231.

Adjacent the P&D station 214 at the downstream end of the input tray transport system 210 is a bar code scanner pair (not shown) that is connected to the control system 238. The control system 238 reads the bar code on any tray 46 before that tray 46 reaches the input P&D station 214.

The apparatus 10 operates as follows:

It should be recalled that letters are sorted to individual area routes by passing the letters twice through the DBCS 14. Letters are put into the receiving means 18 for first pass, and the DBCS 14 partially sorts the letters and dispenses the letters to the output stackers 22. The letters are then put into the receiving means for second pass, and the DBCS 14 dispenses to the output stackers 22 letters sorted to the individual carrier routes.

Before mail sortation by the DBCS 14 may begin, the sweep racks 30 and 54 must be staged or supplied with empty mail trays. The empty trays are distributed on the sweep racks 30 and 54 by placing stacks of empty trays on the non-powered skate wheel conveyor 58 at the uppermost level of the sweep racks and pushing the trays along in slugs. An empty tray 46 is placed in each of the three sloped staging positions in the sweep racks 30 and 54. In addition, eight to nine empty trays are positioned on the top level of the sweep racks at each horizontal position.

Alternatively, stacks of nested empty trays are placed on the input tray transport system 210 at the tray induction station 212. Three to six empty trays are placed in each stack. The stacks of empty trays are allowed to travel along the input tray transport system 210 to the downstream end of the tray transport system 210. Once all staging positions are staged with an empty tray 46 and there are sufficient extra empty trays staged on the top level of the sweep racks, the input tray transport system 210 is cleared of all empty trays.

Next, a bar code tag 47 is placed on each of the trays staged in the staging positions in the sweep racks. The bar code label 47 identifies the DBCS output stacker 22 that the mail is transferred from as it is placed in the empty tray 46. The preprinted labels 47 are inserted into existing plastic sleeves provided on the mail trays 46.

All carts of trayed mail to be processed at the DBCS 14 are delivered to the tray induction station 212 at the upstream end of the input tray transport system 210. The trays are unloaded onto the input tray transport system 210 and allowed to travel to the P&D station 214 (see FIG. 5) at the downstream end of the input tray transport system 210. At this point in the operation the staging rack 70 is empty.

As the trays are processed at the P&D station 214, the bar code on each tray 46 is scanned by the bar code scanner pair. Each tray of mail to be processed at the DBCS 14 arrives with a bar code label that was attached at the previous station. A positive read of the bar code label informs the apparatus 10 that the tray 46 requires first pass processing.

The trays arriving at the P&D station 214 are stored by the storage and retrieval machine 90 in the staging rack 170. Any empty location in the staging rack 70 may be used. To minimize the access time of the storage and retrieval machine 90, the trays are first placed in the staging rack 70 in the positions closest to the output P&D stations 231. The three levels of output belts 226 in the staging rack 70 serve as input positions from the sweep rack 54 at the end of both sortation passes and are not accessible the storage and retrieval machine 90.

Sufficient staging rack capacity has been provided to stage all of the trays requiring first pass processing. There are eight levels in each bay of the staging rack 70. When approximately 80% of the available capacity in the staging rack 70 is utilized, the storage and retrieval machine 90 no longer stores the incoming trays. The trays of mail to be sorted on first pass are then allowed to queue along the entire length of the input tray transport system 210.

When first pass processing of the mail is started, the storage and retrieval machine 90 begins to deliver trays to the DBCS operator via the operator stations. The storage and retrieval machine 90 retrieves the trays arriving at the P&D station 214 at the end of the tray transport system 210 and places the trays on one of the three output P&D stations 231 (i.e., on one of the sets of powered conveyor rollers 231). From here the trays 46 are moved onto the gravity rollers 233 and thus to the feed operator. If a deposit position is not available at one of the output P&D stations 231, the trays are placed in the staging rack 70. The trays of mail on the input tray transport system 210 are the first trays delivered to the DBCS feed operator by the apparatus 10.

After the trays on the input tray transport system 210 have been processed, the storage and retrieval machine 90 begins to retrieve the trays of mail waiting for first pass processing in the staging rack 70 and delivers them to the output P&D stations 231. From here the trays 46 are moved onto the gravity rollers 233 and thus to the feed operator. All of the mail to be processed on first pass has the same priority and is retrieved accordingly.

The sweep operator transfers the sorted first pass mail from the DBCS output stackers 22 to the empty trays in the sweep racks 30 and 54. When a tray 46 is completely filled before first pass is over, meaning there are multiple trays of sorted mail from the same DBCS output stacker 22, the full tray 46 is placed on the input tray transport system 210 and travels to the input conveyor P&D station 214. Such a full tray 46 is referred to as an "overflow" tray. If the input tray transport system 210 is not clear at the position where the overflow tray 46 occurs (the input tray transport system 210 may contain trays waiting for first pass sortation), the tray is placed on the top level of the sweep rack. The trays of mail placed on the top of the sweep racks are placed on the input tray transport system 210 when a clear window appears. The reason the trays on the input tray transport system 210 are processed before the trays in the staging rack 70 is to help maintain open windows on the input tray transport system 210.

As the trays are being processed and as first pass continues, more trays may be introduced at the tray induction station 212 on the input tray transport system 210. As these trays arrive at the P&D station 214 the bar code scanner pair scans the label end of the tray. If a label is read without the first pass bar code 47, the tray is scheduled for immediate first pass processing. When a valid read of a first pass label 47 with the corresponding DBCS output stacker number occurs, the tray is an overflow and is staged in the staging rack 70. This tray remains in the staging rack 70 waiting to be sequenced for second pass processing. The information associated with this tray is entered in the control system database.

First pass sortation ends as all unsorted trays have been processed. The computer control system maintains a count of the trays in the staging rack 70 that are to be sorted on first pass and dynamically updates and displays this information on the control monitor. To reduce the time from the end of first pass to the start of second pass, all overflows are placed on the input tray transport system 210 and staged in the staging rack 70 before the end of first pass processing. At this point in the operation the input tray transport system 210 should be clear.

The first step in preparing to process the mail for second pass is to verify that all of the trays that are overflows for any DBCS output stacker 22 have been placed on the input tray transport system 210.

The sweep operator completely sweeps all first pass mail from each DBCS output stacker 22 and places it in the corresponding tray at the sloped positions in the sweep racks 30 and 54.

Next, the sweep operator places all the trays from the three levels of opposite-side sweep rack 30 onto the input tray transport system 210. It is preferable that these trays be placed on the input tray transport system 210 in exact DBCS output stacker sequence. Not all of the trays from the opposite-side sweep rack 30 are able to queue on the input tray transport system 210. Only the minimum number of trays need to be staged in the staging rack 70 before second pass processing may begin. This leaves the input tray transport system 210 completely loaded as second pass processing begins.

Each of the trays at the near-side sweep rack 54 (even empty trays) is pushed onto one of the three belts 226. Care must be taken to correctly position these trays to ensure the proper orientation on the belts 226. (Overflow trays are not pushed onto the belts 226 in the sweep rack 54 during processing. They are placed on the input tray transport system 210 to be staged in the storage and retrieval machine 90.)

At this point all first pass overflows are in the staging rack 70, the three belts 226 hold the three levels of first pass trays inserted from the near-side sweep rack 54, and the input tray transport system 210 is completely full of first pass trays arriving from the opposite-side sweep rack 30.

When second pass processing is started, the three output belts 226 begin to deliver the trays to the three output P&D stations 231. The trays are advanced into the P&D stations 231 in the exact sequence to correspond to the first DBCS output stacker locations. Only one tray at a time is indexed from the output belt 226 through the P&D station 231 to the associated rollers 233 and thus to the feed operator. Tray sequencing is maintained by presenting only one tray at a time to the feed operator.

All staging positions 34 and 50 are now re-supplied with empty trays from the top level of the sweep racks 30 and 54. The bar code labels 47 printed by the DBCS 14 are inserted in the plastic sleeves attached to the trays 46. The bar code labels 47 contain carrier route and dispatch information.

The control system keeps track of the overflow trays 46 and delivers them as required to match the trays from each DBCS output stacker 22. The overflows are queued in the output P&D stations 231 by the storage and retrieval machine 90 and are released to the operator stations (the rollers 233) under the direction of the control system. Because the overflow trays are completely full, they are the first trays delivered to the DBCS feed operator.

After all the first pass trays on the three levels of belts 226 in the sweep rack 54 have been processed, the storage and retrieval machine 90 begins to deliver to the P&D stations 231 (i.e., to the powered conveyor rollers 231) the trays from the opposite-side sweep rack 30 that have been placed in the staging rack 70.

At the same time trays are being delivered to the output P&D stations 231 for second pass processing, the storage and retrieval machine 90 is transferring trays from the input P&D station 214 to the staging rack 70. The control system continues to dispatch trays to the operator station one at a time in order of DBCS sequence number. These first pass trays are arriving on the input tray transport system 210 from the opposite-side sweep rack. The trays on the input tray transport system 210 are staged as soon as a location in the staging rack 70 is available. The trays on the input tray transport system 210 are in order as placed there by the sweep operator.

The bar code label 47 on the tray identifies a DBCS output stacker location. This data is scanned by the bar code scanner pair and stored in the control system database. This allows the control system to track the overflow trays which are staged by the storage and retrieval machine 90.

The sweep operator performs the same operations on second pass that were performed on the first pass. As trays are filled and overflows occur they are placed on the input tray transport system 210. The overflow trays are placed on the top level of the sweep racks if open windows are not available on the input tray transport system 210. These trays are moved to the input tray transport system 210 as soon as open positions are available.

All of the overflow trays from second pass processing are to be in the staging rack 70 before the mail is dispatched. The sweep operator verifies that all overflows have been placed on the input tray transport system 210, delivered to the input conveyor P&D station 214, and then staged in the staging rack 70.

The sweep operator completely sweeps all second pass mail from each DBCS output stacker 22 and places it in the corresponding tray at the sloped positions in the sweep racks 30 and 54. The operator then pushes all of the trays on the near-side sweep rack 54 onto the three output belts 226.

The trays in the opposite-side sweep rack 30 are placed on the input tray transport system 210 in sequence and delivered to the input P&D station 214. Because of the number of trays at the opposite-side sweep rack 30 it may be necessary to place only half of the trays on the input tray transport system 210. Placement of these trays in dispatch carts at the operator stations 233 will free the input tray transport system 210 to accept the remaining trays from the opposite-side sweep rack 30.

All of the trays to be dispatched are delivered directly to dispatch carts. Before dispatching the mail, all second pass overflow trays are in the staging rack 70, the three belts 226 hold the three levels of second pass trays inserted from the near-side sweep rack 54, and the input tray transport system 210 is completely full of second pass trays arriving from the opposite-side sweep rack 30.

When dispatch is started, the three belts 226 begin to deliver the trays to the three P&D stations 231. The trays are advanced onto the gravity rollers 233 and to the operator in the exact sequence corresponding to the first DBCS output stacker locations. The control system tracks the trays on the belts 226 and directs the storage and retrieval machine 90 to retrieve from the staging rack 70 any overflows to match the trays that are staged at the head or downstream ends of output belts 226. The storage and retrieval machine 90 delivers these overflow trays to one of the three sets of powered conveyor rollers 231. The control system commands the dispensing of trays from either the output belts 226 or the output P&D stations 231 whenever all of the operator stations 233 are determined to be empty. Only one tray at a time is indexed onto one of the three sets of rollers 233 for consistent sequencing of trays to the operator.

Once all of the trays on the three belts 226 have been delivered to the operator and loaded onto dispatch carts, the trays from the opposite-side sweep rack 30 are dispatched. These trays are loaded directly from the input tray transport system 210 onto dispatch carts via operator station 222. Overflows are brought out to match trays which are staged at the head or downstream end of the input tray transport system. The control system either dispatches from the lowest operator station 222 or delivers overflows to the operator stations 233.

Empty dispatch carts are used by the operators for loading the trays 46. The loaded dispatch carts go directly to the shipping dock. After all the trays are on carts and on the way to dispatch, the sweep racks are again staged with empty trays.

Figure 12:
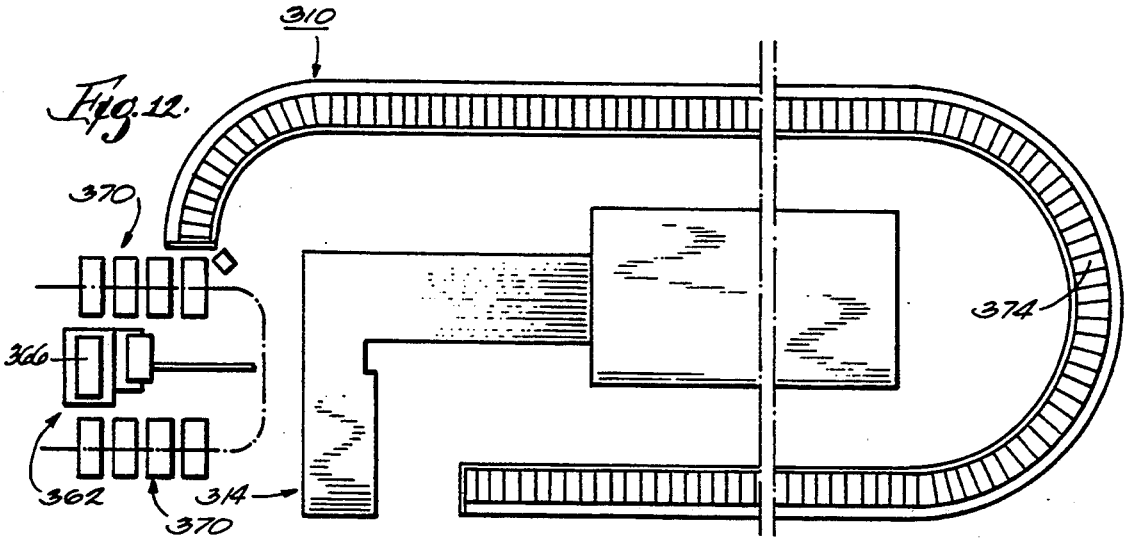
FIG. 12 is a top plan view of an alternative embodiment of the invention which includes a bar code sorter rather than a delivery bar code sorter.

An apparatus 310 which is an alternative embodiment of the invention and which includes a bar code sorter 314 rather than a delivery bar code sorter is shown in FIG. 12. The apparatus 310 comprises an automatic storage and retrieval system 362 including a storage and retrieval machine 366 and a staging rack 370 on each side of the storage and retrieval machine 366. Each rack 370 includes four bays of staging positions. The apparatus 310 also comprises a conveyor 374 between the bar code sorter 314 and the automatic storage and retrieval system 362.

Figure 13:
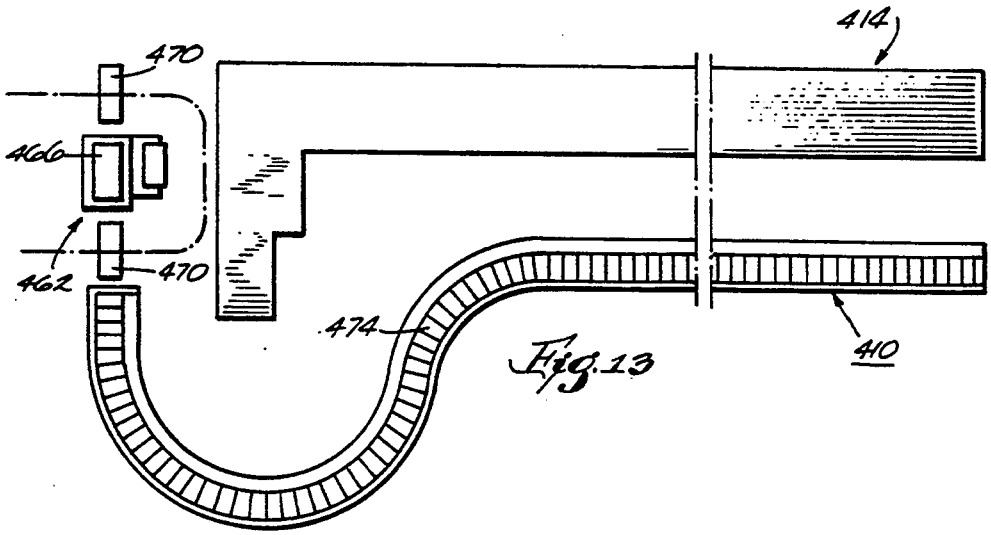
FIG. 13 is a top plan view of a second alternative embodiment of the invention which includes an optical character reader rather than a delivery bar code sorter.

An apparatus 410 which is an alternative embodiment of the invention and which includes an optical character reader 414 rather than a delivery bar code sorter is shown in FIG. 13. The apparatus 410 comprises an automatic storage and retrieval system 462 including a storage and retrieval machine 466 and a staging rack 470 on each side of the storage and retrieval machine 466. Each rack 470 includes one bay of staging positions, so that the mast of the storage and retrieval machine 466 does not have to move horizontally. The apparatus 410 also comprises a conveyor 474 between the optical character reader 414 and the automatic storage and retrieval system 462.

Figure 14:
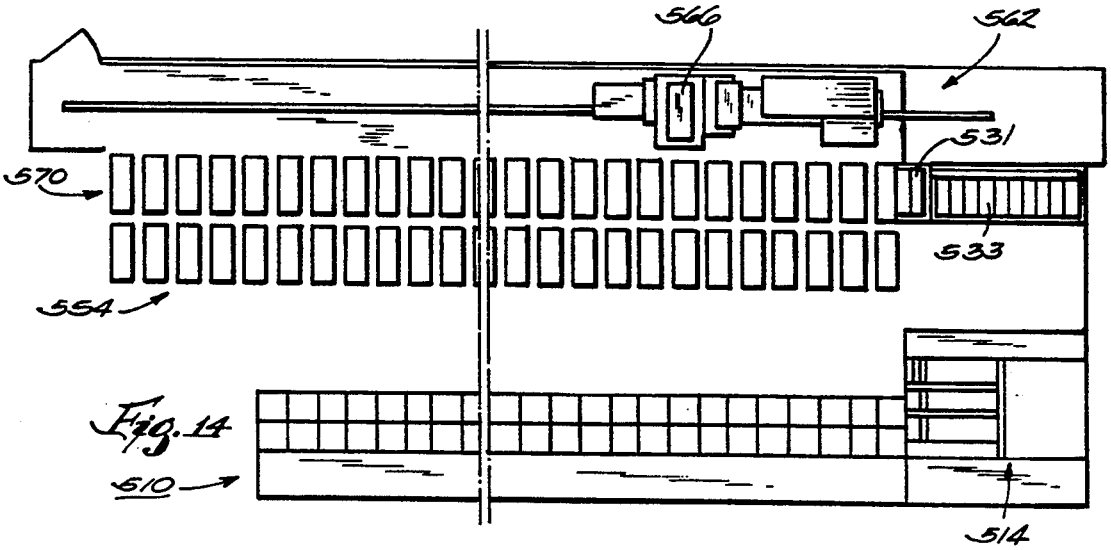
FIG. 14 is a top plan view of a third alternative embodiment of the invention which includes a one-sided delivery bar code sorter rather than a two-sided delivery bar code sorter.

An apparatus 510 which is an alternative embodiment of the invention and which includes a one-sided delivery bar code sorter 514 rather than a two-sided delivery bar code sorter is shown in FIG. 14. The apparatus 510 comprises a sweep rack 554 on the output side of the bar code sorter 514. The apparatus also comprises a storage and retrieval system 562 including a storage and retrieval machine 566 and a staging rack 570 on top of the sweep rack 554. The sweep rack 554 has therein belts (not shown) identical to the belts 210 and 226 of the apparatus 10, rollers (not shown) identical to the rollers 214 and 222 of the apparatus 10, and rollers 531 and 533 (one set is shown) identical to the rollers 231 and 233 of the apparatus 10.

Various features of the invention are set forth in the following claims.

We claim:

1. A letter sorting apparatus comprising a letter sorting machine including means for receiving letters to be sorted, means for sorting letters, and means for dispensing sorted letters which are subsequently placed in letter trays, and means separate from said letter sorting machine for automatically staging the letter trays, said staging means including an automatic storage and retrieval system including means defining a plurality of storage locations, and a storage and retrieval machine which is positioned to receive letter trays from said dispensing means and which is operable to store letter trays in and retrieve letter trays from said storage locations.

2. A letter sorting apparatus comprising a letter sorting machine including means for receiving letters to be sorted, means for sorting letters, and means for dispensing sorted letters, said sorting means sorting letters in at least first and second passes and requiring letters to be presented in a certain order for the second pass, said machine partially sorting letters during the first pass and dispensing partially sorted letters via said dispensing means after the first pass, and said sorting means further sorting the partially sorted letters during the second pass, means separate from said letter sorting machine for automatically staging trays of letters from said dispensing means after the first pass, and means for automatically presenting letter trays so that letters can be input to said receiving means in said certain order for the second pass.

3. An apparatus as set forth in claim 2 and further comprising means for automatically staging letters from said dispensing means after the second pass.

4. An apparatus as set forth in claim 3 and further comprising means for automatically presenting letters in proper order for conveyance after the second pass.

5. An apparatus as set forth in claim 1 wherein said means defining said storage locations defines a plurality of levels each including a plurality of horizontally aligned locations, and a plurality of bays each including a plurality of vertically aligned locations, and wherein said storage and retrieval machine includes a mast movable horizontally adjacent said storage locations, a carriage movable vertically relative to said mast and adjacent said storage locations, and an extractor movable relative to said carriage for placing letter trays in and extracting letter trays from said storage locations.

6. A letter sorting apparatus comprising a letter sorting machine including means for receiving letters to be sorted, said receiving means receiving letters removed from letter trays, means for sorting letters, and means for dispensing sorted letters, and means separate from said letter sorting machine for automatically staging letter trays for input of letters to said receiving means, said staging means including an automatic storage and retrieval system including means defining a plurality of storage locations, and a storage and retrieval machine which is positioned to present letter trays for input of letters to said receiving means and which is operable to store letter trays in and retrieve letter trays from said storage locations.

7. An apparatus as set forth in claim 6 wherein said automatic storage and retrieval system is also operable for automatically staging letters from said dispensing means.

8. A letter sorting apparatus comprising a letter sorting machine including means for receiving letters to be sorted, and means for sorting letters which are subsequently placed in letter trays, and an automatic storage and retrieval system including means defining a plurality of storage locations, said means defining said storage locations defining a plurality of levels each including a plurality of horizontally aligned locations, and a plurality of bays each including a plurality of vertically aligned locations, and a storage and retrieval machine which is positioned to receive trays of letters from said sorting means and to present letter trays for input to said receiving means and which is operable to store letter trays in and retrieve letter trays from said storage locations, said storage and retrieval machine including a mast movable horizontally adjacent said storage locations, a carriage movable vertically relative to said mast and adjacent said storage locations, and an extractor movable relative to said carriage for placing letter trays in and extracting letter trays from said storage locations.

9. An apparatus as set forth in claim 8 wherein said letter sorting machine is modular and includes one or more discrete modules each defining at least one letter dispensing location, and wherein said automatic storage and retrieval system is modular and includes one or more discrete system modules each defining a plurality of said storage locations, such that the number of said storage locations can be varied by varying the number of said system modules.

10. A letter sorting apparatus comprising a letter sorting machine having two sides and including means for receiving letters to be sorted, means for sorting letters, and means on both of said sides for dispensing sorted letters, a first sweep rack adjacent one of said sides for staging trays of letters from said sorting means, said first sweep rack defining a plurality of staging positions defined by respective upwardly facing surfaces, an automatic storage and retrieval system located on the opposite side of said first sweep rack relative to said letter sorting machine, said automatic storage and retrieval system including a staging rack which is located directly above said first sweep rack and which defines a plurality of staging locations, and a storage and retrieval machine operable to stage letter trays in and retrieve letter trays from said staging locations, a first conveyor for transporting letter trays from said first sweep rack to said storage and retrieval machine, said first conveyor extending through said first sweep rack and being located on the opposite side of said staging positions relative to said letter sorting machine such that an operator can push letter trays from said staging positions so that the letter trays slide off said upwardly facing surfaces and onto said first conveyor, a second sweep rack adjacent the other of said sides of said letter sorting machine for staging trays of letters from said sorting means, and a second conveyor for transporting letter trays from said second sweep rack to said storage and retrieval machine, said second conveyor extending through said first sweep rack.

11. An apparatus as set forth in claim 8 wherein said letter sorting machine has two sides and dispenses letters on both of said sides, wherein said automatic storage and retrieval system is located adjacent one of said sides, and wherein said apparatus further comprises means for conveying trays from the other of said sides to said storage and retrieval machine.

12. An apparatus as set forth in claim 8 and further comprising means for conveying letter trays from said sorting means to said storage and retrieval machine.

13. An apparatus as set forth in claim 8 and further comprising means adjacent said sorting means for storing trays of letters from said sorting means, said storing means being located such that an operator can sweep letters from said sorting means into trays supported by said storing means, and means for conveying letter trays from said storing means to said storage and retrieval machine.

14. An apparatus as set forth in claim 8 wherein said means defining said storage locations includes shelves supported such that there are no partitions between adjacent storage locations.

15. A letter sorting apparatus comprising a letter sorting machine having two sides and including means for receiving letters to be sorted, means for sorting letters, and means on both of said sides for dispensing sorted letters, an automatic storage and retrieval system including means defining a plurality of staging locations, and a storage and retrieval machine operable to stage letters in and retrieve letters from said staging locations, first staging means adjacent one of said sides for staging letters from said sorting means, said staging means including means defining a plurality of staging positions, means for transporting letters from said first staging means to said storage and retrieval machine, said transporting means including a transport system located adjacent said staging positions such that an operator can push letter receptacles from said staging positions onto said transport system, second staging means adjacent the other of said sides for staging letters from said sorting means, and means for transporting letters from said second staging means to said storage and retrieval machine.

16. An automatic storage and retrieval system comprising means defining a plurality of storage locations, a storage and retrieval machine operable to store objects in and retrieve objects from said storage locations, storing means defining a plurality of storage positions defined by respective upwardly facing surfaces, and means for conveying objects from said storing means to said storage and retrieval machine, said conveying means including a conveyor located adjacent said storage positions such that an operator can push objects from said storage positions so that the objects slide off said upwardly facing surfaces and onto said conveyor.

17. An automatic storage and retrieval system comprising a lower rack defining a plurality of storage positions, an upper rack which is mounted on top of said lower rack and which defines a plurality of storage locations above said storage positions, said upper rack defining a plurality of levels each including a plurality of horizontally aligned storage locations, a storage and retrieval machine operable to store objects in and retrieve objects from said storage locations, said storage and retrieval machine including a mast movable horizontally adjacent said storage locations, a carriage movable vertically relative to said mast and adjacent said storage locations, and an extractor movable relative to said carriage for placing objects in and extracting objects from said storage locations, and a conveyor for conveying objects from said lower rack to said storage and retrieval machine.

18. A method of handling letters being sorted by a letter sorting machine, said method comprising the steps of providing an automatic storage and retrieval system including means defining a plurality of staging locations, and a storage and retrieval machine, transporting letters in trays from the sorting machine to said storage and retrieval machine, and operating said storage and retrieval machine to stage letter trays in and retrieve letter trays from said staging locations.

19. A method of handling letters being sorted by a letter sorting machine, said method comprising the steps of providing an automatic storage and retrieval system including means defining a plurality of staging locations, and a storage and retrieval machine, transporting letters in trays to said storage and retrieval machine, and operating said storage and retrieval machine to stage letter trays in and retrieve letter trays from said staging locations and to stage letters for input to the letter sorting machine.

20. An apparatus as set forth in claim 11 and further comprising storing means adjacent said other of said sides for storing letter trays, said storing means being located such that an operator can sweep letters from said sorting means into trays supported by said storing means, and wherein said conveying means conveys letter trays from said storing means to said storage and retrieval machine.

21. An apparatus as set forth in claim 14 wherein said means defining said storage locations also includes cantilever supports for said shelves.

22. A letter sorting apparatus comprising a letter sorting machine including means for receiving letters to be sorted, and means for sorting letters, said letter sorting machine being modular and including a plurality of discrete modules each having a module length and defining at least one letter dispensing location, and an automatic storage and retrieval system including means defining a plurality of storage locations, and a storage and retrieval machine which is positioned to receive letters from said sorting means and to present letters for input to said receiving means and which is operable to store letters in and retrieve letters from said storage locations, said automatic storage and retrieval system being modular and including a plurality of discrete system modules each having a length substantially equal to said module length and each defining a plurality of said storage locations, such that the number of said storage locations can be varied by varying the number of said system modules, and such that the length of said automatic storage and retrieval system can be adapted to the length of said letter sorting machine.

23. A method of handling letters being sorted by a letter sorting machine which sorts letters in at least first and second passes, said method comprising the steps of:

A) providing an automatic storage and retrieval system;

B) inputting letters to the letter sorting machine for the first pass;

C) manually removing partially sorted letters from the letter sorting machine after the first pass, placing the partially sorted letters in trays and placing the trays of partially sorted letters in the automatic storage and retrieval system;

D) operating the automatic storage and retrieval system to stage the partially sorted letters after the first pass and to thereafter present the partially sorted letters in proper order for input to the letter sorting machine for the second pass; and E) manually removing the partially sorted letters from the automatic storage and retrieval system by removing the partially sorted letters from the trays and inputting the partially sorted letters to the letter sorting machine for the second pass.

24. A method as set forth in claim 23 wherein the letter sorting machine has a plurality of output locations, and wherein step C further includes the steps of providing a plurality of trays each corresponding to a respective one of the output locations, and placing the letters from each output location in the corresponding tray.

25. A system as set forth in claim 17 wherein said conveyor has on output end, and wherein said storage and retrieval machine is operable to remove objects from said output end.

26. A system as set forth in claim 25 wherein said mast has a direction of movement, and wherein said conveyor is located directly beneath said storage locations and moves parallel to said direction of movement of said mast.

* * * * *